US005320927A

United States Patent [19]

Fender et al.

[11] Patent Number: 5,320,927

[45] Date of Patent: Jun. 14, 1994

[54] PROCESS FOR MANUFACTURING AN IMPROVED SELENIUM ALLOY X-RAY IMAGING MEMBER ON TRANSPARENT SUBSTRATE

[75] Inventors: William D. Fender; Eddie M. Zanrosso, both of Pasadena; Algird G. Leiga, Claremont, all of Calif.; Robert Manchego, Rochester, N.Y.

[73] Assignee: Xerox Corporation, Stamford, Conn.

[21] Appl. No.: 106,958

[22] Filed: Aug. 17, 1993

Related U.S. Application Data

[63] Continuation-in-part of Ser. No. 891,110, Jun. 1, 1992.

[51] Int. Cl.[5] ..... G03G 5/082

[52] U.S. Cl. ..... 430/128; 427/76; 427/294; 427/295; 430/60; 430/66; 430/85

[58] Field of Search ..... 430/128; 427/76, 294, 427/295

[56] References Cited

U.S. PATENT DOCUMENTS 4,126,457 11/1978 Ciuffini ..... 430/128
4,770,965 9/1988 Fender et al. ..... 430/128 X

FOREIGN PATENT DOCUMENTS 11945 1/1988 Japan ..... 430/128

*Primary Examiner*—Roland Martin
*Attorney, Agent, or Firm*—Robert E. Cunha

[57] ABSTRACT

A method for vacuum depositing a selenium-arsenic coating on a substrate to form a photoreceptor by evaporating selenium with an arsenic concentration of 0.1 to 0.6 percent by weight and discontinuing the evaporation when the weight of the selenium alloy remaining is 2–10 percent of the original weight.

2 Claims, 2 Drawing Sheets

PROCESS FOR MANUFACTURING AN IMPROVED SELENIUM ALLOY X-RAY IMAGING MEMBER ON TRANSPARENT SUBSTRATE

BACKGROUND OF THE INVENTION

This application is a continuation-in-part of application Ser. No. 07/891,110, filed Jun. 1, 1992, status pending.

The invention described herein relates to planar selenium-arsenic based photoreceptors used for digital as well as conventional dry powder x-ray imaging and, in particular, to the vacuum coating and overcoating manufacturing processes used in their preparation.

The prior art includes the following:

W. D. Fender, "Quantification of the Xeroradiographic Discharge Curve," SPIE Vol. 70, 1975, 364.—Chlorine and arsenic doped amorphous selenium photoreceptors are disclosed having a thickness of 120 to 300 microns. The x-ray photogeneration constant and relationship of charging potential to photogenerated charge signal are measured and quantified. In reference to this invention, the paper shows that the photogenerated charge signal is directly proportional to the internal field or charging potential, for a given selenium thickness, that the photoreceptor can sustain without exhibiting excessive artifact levels.

W. Hillen et al., "Imaging Performance of a Selenium Based Detector for High-Resolution Radiography," SPIE Med. Imaging III, 1989 and "A Selenium Based Detector System for Digital Slot Radiography," SPIE Vol. 914, Medical Imaging II, 1988.—A selenium drum x-ray fan-scanning ganged-detector readout system is described. The x-ray source slit may increase tube loading and exposure times to excessive levels. Coupling of the two scanning slits and drum synchronization over the object or patient may be awkward due to the possible interference of these various members.

D. M. Korn et al., "A Method of Electronic Readout of Electrophotographic and Electroradiographic Images," JAPE, Vol. 4, No. 4, Fall, 1978.—An amorphous selenium photoconductor fashioned in a strip electrode configuration and associated electronic readout are described. The system is on an opaque substrate and is designed for front exposure and readout. The proposed device may not have the resolution capability needed for mammography due to the embedded strip configuration. Further, processes which allow high charging and prevention of artifacts and crystallization are not discussed.

U. Schiebel, "Image Quality in Selenium Based Digital Radiography," SPIE vol. 626, Medicine XIV, PACS IV, 1986.—A front surface exposure, strip-electrode probe front-surface-reading system is described utilizing a conventional selenium receptor. No provisions are made for back surface access, minimization of crystallization nor for high charging fields and the ensuing increase in sensitivity and charge signal.

R. C. Speiser et al., "Dose Comparisons for Mammographic Systems," Med. Phys. 13(5), September/October, 1986, 667.—A selenium photoreceptor is disclosed and x-ray sensitivity is discussed and compared with film-screen mammographic imaging.

In U.S. Pat. No. 3,970,844 to Finn Jr. et al., an ionographic gaseous x-ray receptor scanning system is disclosed which utilizes embedded electrode strips for image readout. Ionographic systems require a large thick-walled somewhat bulky design due to the need to pressurize the ionographic gas. The embedded electrode strips may not provide the resolution needed for x-ray mammography.

U.S. Pat. No. 4,085,327 to Swank et al., a charge readout device is disclosed utilizing a receptor of transparent layers of strips configured in such a manner as to minimize the series capacitance in parallel with the output signal. Little is said about the photoconductive x-ray sensitive material or about how such a device would be manufactured. Again, resolution may be limited by the strip spacing.

In U.S. Pat. No. 4,126,457 to Ciuffini, a method for producing a flexible photoreceptor is disclosed wherein the photoreceptor comprises a selenium alloy layer containing a concentration gradient of arsenic. The thickness of the alloy layer deposited in the working examples was about 60 microns, a typical thickness for line copier receptors and is below the 100 to 400 micron thickness needed for x-ray imaging. The photoreceptor of Ciuffini can contain high levels of arsenic which may cause reticulation, a chronic failure mode of thermally relaxed selenium x-ray photoreceptors not having correctly configured arsenic profiles.

In U.S. Pat. No. 4,298,671 to Kassel et al., an electrophotographic recording material is disclosed comprising a layer of amorphous selenium and a layer of crystalline selenium. The device consists of an opaque electrically conductive substrate upon which is vapor deposited a thin layer of tellurium. A layer of crystalline selenium is deposited on the tellurium followed by a layer of amorphous selenium on the crystalline selenium layer. The photoreceptor of Kassel et al., is designed for monopolar transport on an opaque substrate and is not configured for image scanning from the back surface.

In U.S. Pat. No. 4,521,808 to Ong et al., an image scanning apparatus is disclosed for obtaining a radiographic image. The photoreceptor is a standard Xerox 125 selenium plate with a Mylar top surface transparent electrode added. The device x-ray images through the 0.080 inch aluminum substrate which significantly increases the radiographic patient dose and renders the unit impractical for mammography. Laser scanning is performed from the top side through the added Mylar electrode which is used for image readout.

In U.S. Pat. No. 4,770,965 to Fender et al., a state-of-the-art one hundred and fifty micron thick photoreceptor is described in Example I, while an improved thick, high-sensitivity 320 micron photoreceptor is described in Example II. The examples and claims do not, however, include a transparent substrate for digital scanning nor is a multilayered configuration having a fractionated arsenic profile disclosed, other than requiring the top surface arsenic level not exceed 2% to prevent the reticulation artifact, a catastrophic wrinkling of the top surface.

In U.S. Pat. No. 4,961,209 to Rowlands et al., an x-ray image-scanning system is disclosed which utilizes a standard flat selenium photoreceptor having a movable transparent slit sensor electrode through which a traversing light beam discharges the photoreceptor in a raster pattern after x-ray exposure. One function of the moving slit electrode is to minimize the coupling capacitance in parallel with the sensed signal charge. The disclosure does not teach a transparent substrate nor does it specify arsenic profiling at either of the interfaces to minimize artifacts, increase life, charging potential or image contrast.

In U.S. Pat. No. 5,023,661 to Fender et al., a precharging process step is described for the x-ray selenium photoreceptor used in Xeromammography which removes a critical artifact called x-ray fatigue. The interface crystallite origin of the fatigue artifact and its role in injecting spurious charge into the photoreceptor also is shown in detail. The disclosure does not teach an arsenic profile at the interface which would eliminate the microcrystallites and the fatigue artifact they produce In U.S. Pat. No. 3,655,377 to Sechak, a panchromatic, three-layer drum line-copier photoreceptor is described which allows black and white, or in special applications, color copies to be made of either black and white or color originals. The disclosure is therefore specifically configured and tailored to the visible rather than to the mammographic x-ray spectrum. The function, composition, dimensions and purpose of the three layered structure, therefore, is distinctly different from the invention disclosed herein. The first layer, for example, is the bulk layer in the Sechak receptor and is 40 to 100 microns in thickness, as is typical for drum copiers. No mention is made for the protection of the substrate interface by this first layer from microcrystallites which can cause the x-ray fatigue artifact.

SUMMARY OF THE INVENTION

This invention is a process for manufacturing a flat plate selenium alloy electrophotographic imaging member having either an optically-transparent electrically-conductive tin oxide coated substrate or a conventional aluminum substrate. The bulk selenium layer is comprised of an arsenic, chlorine doped x-ray and light sensitive alloy 100 to 400 microns in thickness. Said bulk layer shall have at its surface a fractionated arsenic rich layer of 3 to 10 microns in thickness and 1.5 to 3.5 percent in top surface arsenic concentration. Further, said bulk layer shall be interposed between two arsenic rich protective layers, one on the top surface and the other on the opposite side contiguous with the substrate, either protective layer having a thickness of 0.05 to 5 microns. The top layer shall be deposited form an arsenic-selenium alloy having 1 to 3 percent arsenic by weight while the bottom layer shall be deposited from alloy containing 1 to 24 percent arsenic by weight.

The x-ray image is formed from the side of the photoreceptor opposite the transparent substrate and then is scanned from the back side through the transparent substrate with a fine beam of light, the position of which is precisely monitored. Said scanning light beam may be a gas laser such as a Helium-Neon, Argon or dye laser or could be an aluminum doped gallium-arsenide laser or diode array. The beam positioning and monitoring may be controlled by angulated or polygon mirrors, flexible fiber optics or through multiaxis translation as in the case of a laser diode array. The ensuing discharge from the aforementioned light beam is detected by a non-contacting x-ray transparent electrode located on the outer side of the photoreceptor, away from the substrate which reads the discharge signal through capacitive coupling pixel by pixel according to the known position of the light beam, to form a high resolution raster pattern digital readout of the image suitable for digital processing, enhancement, hard-copy generation and CRT monitor display.

In the past, selenium x-ray photoreceptors have been degraded by reticulation, a catastrophic wrinkling of the top surface, as well as by the formation of microcrystallites which result in point defect sites. Reticulation is caused by excessive thickness and concentration of arsenic near the photoreceptor top surface. Arsenic tends to fractionate from the bulk alloy as it is vacuum deposited thereby depositing on the top surface. Moreover, the bulk of an x-ray photoreceptor is much thicker, as noted, than in copier photoreceptors and thereby provides more opportunity for arsenic fractionation. Selenium crystallization is caused by the action of the thermal relaxation cycle, unique to the x-ray electrostatic imaging, on the photoreceptor top surface, bulk and substrate interface. While arsenic in these areas tends to retard crystallization, it can also increased dark decay and reduce x-ray sensitivity if placed in inappropriate locations or at excessive concentrations. In this invention, increased concentrations and precise thicknesses of arsenic are placed where they will be the most effective and least detrimental to the x-ray photoreceptor. One of the added benefits of correct arsenic placement, in addition to reduced reticulation and crystallization, is longer photoreceptor life and an increase in the resultant allowed charging potential thereby providing greater x-ray sensitivity and image quality. The invention, therefore, is a durable, longer-life, increased-sensitivity, multilayered, planar x-ray selenium photoreceptor deposited on an optically-transparent substrate described in the context of a high resolution image scanner.

A major advantage of the invention is to provide access to the photoreceptor from both sides for x-ray exposure, light-beam discharge scanning and sensing of the discharge magnitude on a pixel by pixel basis. Typically, scanning systems proposed to date exhibit high dose due to x-ray exposure through a heavily attenuating aluminum substrate or are awkward and mechanically complex from various mechanisms needed to discharge and simultaneously read the discharge signal from the top surface.

Further, photoreceptor durability and resistance to crystallization and the various associated artifacts have imposed serious constraints on digital and conventionally-developed systems from the viewpoints of both cost and design. The device described herein overcomes these limitations through the use of an optimally configured arsenic-fractionated layer at the surface of the bulk-deposited selenium and through the use of high arsenic protective layers above and below said bulk layer. The result of this invention is a practical system configuration for achieving high resolution digital mammography or radiography with a longer-life, artifact-resistant photoreceptor capable of sustaining greater internal fields associated with increased charging potentials resulting in greater x-ray sensitivity and improved image quality.

It is, therefore, an object of the present invention to provide a manufacturing process for producing a selenium x-ray photoreceptor to be used in an electrophotographic digitized x-ray image scanning system which overcomes the problems encountered with electrophotographic digitized image scanning systems of the prior art.

It is a further object of the present invention to provide a process for mass producing selenium x-ray photoreceptors which overcome manufacturing problems with production of amorphous selenium photoreceptors of the prior art.

It is a further object of the present invention to provide an improved amorphous selenium x-ray photoreceptor which overcomes problems encountered with amorphous x-ray selenium photoreceptors of the prior art.

It is a further object of the present invention to provide a production process for an amorphous selenium photoreceptor having an optically transparent substrate to allow discharge of said photoreceptor from the rear through the transparent substrate.

It is a further object of the present invention to provide a production process for an amorphous selenium photoreceptor which minimizes localized selenium crystallization at the top surface and at the substrate interface and minimizes artifacts associated with said crystallization such as x-ray fatigue.

It is a further object of the present invention to specify a vacuum coating process which will provide the arsenic gradients at the top surface and at the substrate interface which are needed to retard the formation of localized crystallization sites and the resultant artifacts associated with said crystallites such as x-ray fatigue. Moreover, the top surface arsenic profile will be specified in such a manner that reticulation, a catastrophic wrinkling of the top surface caused by excessive arsenic levels, will be avoided.

It is a further object of the present invention to provide a manufacturing process for producing a more sensitive x-ray photoreceptor resulting from the better interface protection provided by the increased arsenic concentrations present at the top surface and substrate interfaces thereby allowing higher photoreceptor charging potentials to be used. The increased photogeneration provided by higher charging levels has an added benefit of providing greater charge-contrast which results in improved image-contrast and better visualization of image detail.

It is a further object of the present invention to provide a manufacturing process for producing a longer-life photoreceptor which can withstand the rigors of the thermal relaxation process typically used in x-ray imaging to remove the prior residual image from the photoreceptor. Because x-ray photoreceptors typically last only a few hundred cycles, the improvement in cycle life provided by this invention would lower the cost to the customer.

It is a further object of the present invention to provide an increased photoreceptor yield in the manufacturing process through a reduction in surface and substrate interface crystallization artifacts and the defect sites that result from such crystallites.

It is a further object of the present invention to provide a means for stripping and recoating the organic overcoating, when the need occasionally arises, without the use of a separate stripping operation.

DETAILED DESCRIPTION OF THE INVENTION

The planar amorphous x-ray selenium-arsenic photoreceptor manufactured from the process of this invention utilizes a transparent substrate over which is formed an optically-transparent electrically-conductive electrode such as NESA, tin oxide or ITO, indium tin oxide. To minimize reticulation, a destructive wrinkling of the top surface and the formation of microcrystallite defect sites, hitherto a major problem in photoreceptors of this type, the photoreceptor arsenic profile is precisely configured at the top surface facing away from the substrate and at the interface adjacent to the substrate in the following manner so as to minimize the formation of selenium crystallites. It should be noted that excessive concentrations or thicknesses of arsenic cause reticulation, a wrinkling of the top surface, as well as a loss in x-ray sensitivity and image quality. Insufficient arsenic, on the other hand, can lead to the formation of microcrystallites and concomitant artifacts such as x-ray fatigue.

The aforementioned arsenic profiling is accomplished through two distinct methods. First, the high arsenic layers at the substrate interface and at the top surface of the bulk layer are applied through complete evaporation of a separate high-arsenic containing alloy evaporated from small crucible strings in the vacuum coater which are separate from the larger primary array crucible strings. Secondly, due to the tendency for arsenic to fractionate within the central selenium arsenic bulk, the top surface arsenic level of this central bulk layer is tailored to a thickness range of 3 to 10 microns and to a maximum and a minimum top surface concentration range of 1.5 to 3.5 percent as measured with secondary ion mass spectometry, SIMS. This tailoring of the central bulk layer top surface arsenic is accomplished by ending the evaporation cycle just before evaporation completion, when 2 to 10 percent of the original material remains, as determined by a strain-gauge mounted vacuum coater crucible array which functions as a precision analytical balance.

Figure 1:
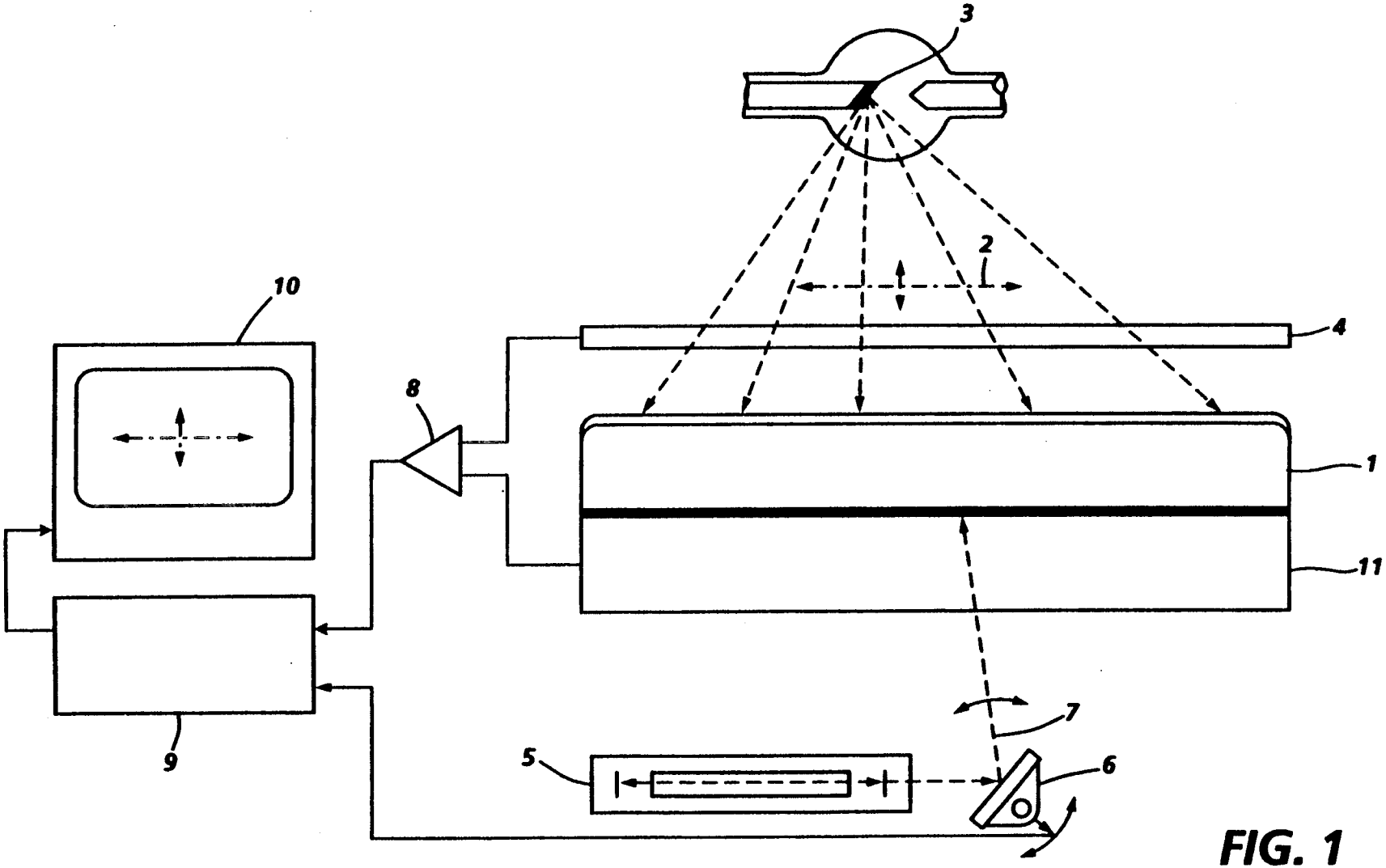
FIG. 1 is a cross-section of the photoreceptor shown in greater detail.

The photoreceptor, shown in FIG. 1, consists of a transparent substrate (1) coated with an optically-transparent, electrically-conductive NESA, tin oxide, or ITO, indium tin oxide, interface (2) to a resistivity of 100 to 10,000 ohms per square. The coated substrate is cleaned with a suitable cleaning agent such as deionized water and is mounted in a mask assembly which is placed on the vacuum coater rotating mandril assembly. The described transparent substrate is of greatest value in digital imaging, however, it could be used in a conventional powder or liquid development system as well, in place of the standard aluminum substrate. Similarly, the following photoreceptor improvements and features exemplify the optimal configuration for a digital x-ray imaging photoreceptor and for a conventional aluminum substrate photoreceptor as well. The photoreceptor related portion of this invention therefore applies to conventional powder or liquid development as well as to digital imaging using either a transparent or an aluminum substrate.

After heating the mandril-mounted substrate with a glow discharge cycle to a minimum temperature of about 85° C. (185° F.) an interface layer (3) of 1 to 24 percent arsenic selenium is evaporated to a thickness of 0.05 to 5 microns. The purpose of said high arsenic interface layer is to retard crystallite formation at the interface and to thereby avoid such interface crystallite-caused artifacts as x-ray fatigue, described in U.S. Pat. No. 5,023,661. This intermediate layer is commonly not used in most production operations but may be used at the manufacturer's discretion, particularly in instances where interface-related-artifacts pose a problem. When this intermediate layer is not used, the bulk layer described below is deposited directly on the substrate.

The aforesaid interface layer is followed by a vacuum deposition of the bulk layer (4) of amorphous selenium as described in the six examples of U.S. Pat. No. 4,770,965. The evaporation cycle and ensuing arsenic fractionation which, if carried to completion, could result in an excessive level of top surface arsenic, is cut off at a precise point to allow just enough arsenic to harden the photoreceptor surface against crystallization but not so much as to result in a catastrophic reticulation failure mode which is a wrinkling of the top surface. The precise method by which this critical cutoff point is determined as well as the vacuum coater and other hardware used in the photoreceptor manufacturing process is described in the subsequent paragraphs.

The bulk-layer fractionated top-surface arsenic profile (5) and concentration that has been found most suitable with respect to the aforesaid tradeoff between crystallization minimization and reticulation is one which ramps approximately linearly from the bulk concentration of 0.1 to 0.6 percent by weight to a top surface arsenic concentration of 1.5 to 3.5 percent over a depth of 3 to 10 microns. The crucible power cutoff point which best achieves the specified top surface arsenic level and thickness is one which leaves 2 to 10 percent of the original bulk selenium alloy weight in the crucible array. Arsenic concentration is measured with a secondary ion mass spectrometer, SIMS, using an $O_{16}$ oxygen primary beam of 80 to 90 nanoamperes at an accelerating potential of 12.5 KV.

The photoreceptor is operable and durable at this point in the process. However, if the manufacturer prefers, he has the option of applying an additional protective layer to the photoreceptor for additional surface durability. A thin top surface layer of 1 to 3 percent arsenic-selenium (6) is applied from a third small crucible string to a thickness of 0.05 to 5 microns at a crucible evaporation temperature of 315° C. (600° F.) to 371° C. (700° F.). This evaporation, as in the case of the interface protective layer, is performed rapidly and proceeds to completion in a matter of seconds, unlike the previously described much thicker bulk layer (4).

An overcoat is not normally required. However, some users have to use the photoreceptor in environments that have particularly troublesome contaminants. For these, an organic cyclohexanone solvent based overcoating (7) may be applied under clean-room conditions according to the procedure outlined in U.S. Pat. No. 4,770,965. Occasionally, it is necessary to strip and re-overcoat the photoreceptor to eliminate unwanted artifacts resulting from surface contaminants drying in the overcoating on the photoreceptor top surface. We have found that a solvent stripping operation is unnecessary and can be avoided merely by re-applying the overcoating solution over the original cured overcoating and that such action is sufficient to simultaneously strip, rinse and re-apply the overcoating. In the case of top surface inclusion related defect sites, we have found this method to be approximately fifty percent effective in recovering photoreceptors which otherwise would have been rejected.

Figure 2:
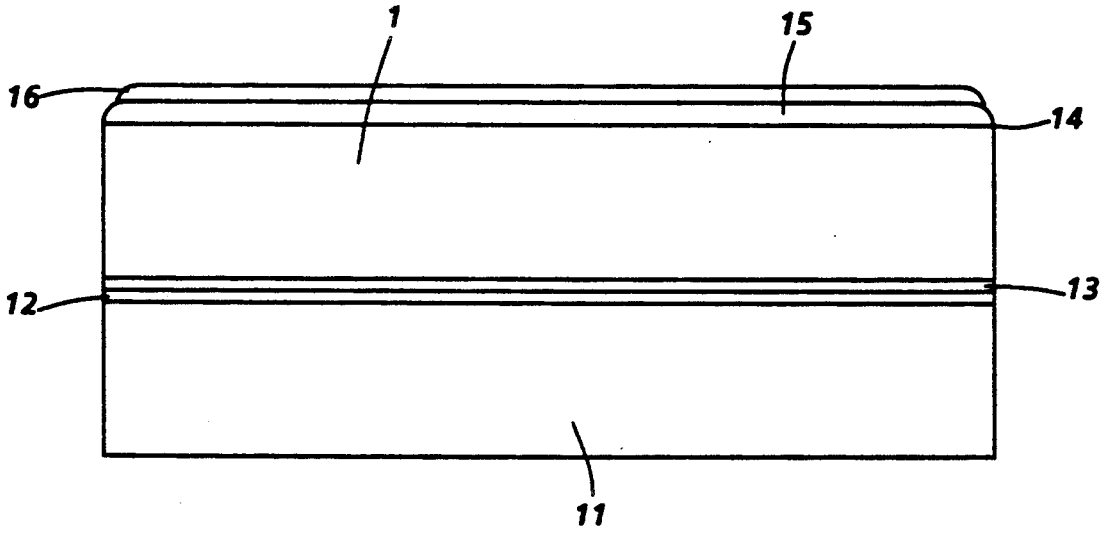
FIG. 2 is an isometric view of the vacuum coater crucible array showing the three point strain-gauge suspension.

The vacuum coater crucible array, shown in FIG. 2, is located just below the previously referenced vacuum coater horizontal rotating mandril on which the transparent or aluminum substrates are mounted for vacuum coating. The horizontal hexagonal cross-section mandril holds six substrates about its circumference on each of eight ring-sections along its length thereby retaining a total of 48 substrates. As the mandril rotates over the crucible array, as a spit is rotated over a fire, the glow discharge cycle is performed, heating the mandril retained substrates to a minimum temperature of about 85° C. (185° F.) and pressure of 20 to 30 microns absolute pressure to maintain the glow discharge.

Immediately following the glow discharge cycle, one of the two small central crucible strips (1) is resistively heated evaporating all of the high arsenic selenium pellets which form the high arsenic substrate interface layer. This first of three depositions, therefore, is run to completion. The four primary crucible array strips (2) are located on both outer sides of the array assembly shown in FIG. 2. It is these four large crucible strips which deposit the bulk layer of selenium arsenic alloy, as they are resistively heated, to a precisely controlled time-temperature profile through the use of a Microcon 823 temperature controller system. Each of the four primary crucible array strings contains a series of 23 individual depressions or boats (3) into which the selenium-shot is loaded before closing of the bell jar and evacuation.

The crucible-array assembly is suspended from a three point strain-gauge mounting system which functions as a precision electronic balance. Each crucible array string is tensioned by means of a leaf spring assembly (4) so that as the crucibles are resistively heated and expand over their ten foot length each is held straight and flat and thereby prevented from contacting and electrically shorting an adjacent crucible string. The crucible strings are retained on a rigid crucible box frame (5) by means of the spring tensioners. The crucible box frame is suspended from the main array support beams (6) which are cantilevered from the vertical surface of the vacuum coater bulkhead.

Two Interface inc. MB50s (7) and one MB100 (8) minibeam load-cells are mounted to the frame of the vacuum coater from which steel cables (9), a few inches in length, are attached on which the crucible array is suspended. We have found that three-point suspension is critical to the accuracy of the array precision balance due to the tendency of the 10 foot long array to expand and warp as it is heated under vacuum. The suspension, moreover, assures that the strain-gauges are subjected only to a single unidirectional tensil force without torsion-inducing components which have been found to reduce the accuracy of the array balance.

In operation, the array is routinely calibrated using a known standard weight to obtain a conversion between the millivolt potential output of the strain gauges and a weight unit such as grams. The weight of the loaded selenium is determined by subtracting the loaded array reading from the unloaded reading in air. A fraction of that weight, typically 2 to 10 percent, is calculated which is subtracted from the weight of the loaded array in vacuum to determine the evaporation end point. During evaporation, when the precalculated end point is reached, the power to the system is ramped down thereby providing the top surface arsenic concentration and depth which is sufficient to minimize surface crystallization but not so great as to induce the reticulation failure mode.

The top surface arsenic profile and concentration that has been found most suitable with respect to the aforesaid tradeoff between crystallization-minimization and reticulation is one which ramps approximately linearly from the bulk concentration of 0.1 to 0.6 percent by weight to a top surface arsenic concentration of 1.5 to 3.5 percent over a depth of 3 to 10 microns.

A thin 0.05 to 5 micron top surface layer of 1 to 3 percent arsenic is applied from a second small crucible string (10). This evaporation, as in the case of the interface protective layer, is performed rapidly and proceeds to completion in a matter of seconds, unlike the previously described much thicker bulk layer.

Although the invention has been described with reference to specific preferred embodiments, it is not intended to be limited thereto, rather those skilled in the art will recognize that variations and modifications may be made therein which are within the scope of the invention and within the scope of the following claims.

We claim:

1. A method for producing a selenium layer on a substrate of a photoreceptor in a vacuum coater, said selenium layer having a bulk thickness of 100 to 400 microns and a bulk arsenic concentration of 0.1 to 0.6 percent by weight, said arsenic concentration rising to a level of 1.5 to 3.5 percent by weight at the top surface to form a fractionated layer 3 to 10 microns in thickness, comprising the steps of a) evaporating selenium having an arsenic concentration of 0.1 to 0.6 percent onto said substrate, b) continuously weighing the selenium being evaporated, and c) discontinuing said evaporation when the weight of the selenium alloy remaining is 2 to 10 percent of the original weight.

2. The method of claim 1 further comprising:

before step a), completely evaporating in said coater an amount of selenium alloy having an arsenic concentration of 1 to 24 percent by weight to produce a photoreceptor selenium bottom layer thickness of 0.05 to 5 microns, and after step c), completely evaporating an amount of selenium alloy having an arsenic concentration of 1 to 3 percent by weight to produce a photoreceptor selenium top layer thickness of 0.05 to 5 microns.

* * * * *